US006510880B2

(12) United States Patent
Arasmith

(10) Patent No.: US 6,510,880 B2
(45) Date of Patent: Jan. 28, 2003

(54) LUMBER TRIM END CHIPPER

(76) Inventor: Stanley Dale Arasmith, P.O. Box 2458, Rome, GA (US) 30164

( * ) Notice: Subject to any disclaimer, the term of this patent is extended or adjusted under 35 U.S.C. 154(b) by 0 days.

(21) Appl. No.: 09/838,471

(22) Filed: Apr. 19, 2001

(65) Prior Publication Data

US 2002/0062878 A1 May 30, 2002

Related U.S. Application Data

(60) Provisional application No. 60/198,302, filed on Apr. 19, 2000.

(51) Int. Cl.[7] ..... B27C 1/00; B27C 19/00; B27B 1/00

(52) U.S. Cl. ..... 144/373; 144/162.1; 144/174; 144/242.1; 144/245.1; 144/172; 241/282

(58) Field of Search ..... 144/162.1, 172, 144/173, 174, 180, 242.1, 245.1, 245.6, 363, 373; 241/280, 282

(56) References Cited

U.S. PATENT DOCUMENTS 3,195,594 A 7/1965 Bloomquist et al.
3,688,997 A 9/1972 Ullener
3,690,568 A 9/1972 Alexander
4,305,590 A 12/1981 Haikkala et al.
4,444,234 A 4/1984 Arasmith
4,569,380 A 2/1986 Arasmith
4,595,150 A 6/1986 Aario
4,697,626 A 10/1987 Arasmith
4,776,375 A 10/1988 Arasmith
4,785,860 A 11/1988 Arasmith
4,874,024 A 10/1989 Arasmith
5,070,918 A 12/1991 Pallmann
5,957,178 A * 9/1999 Arasmith ..... 144/162.1 X
6,125,897 A * 10/2000 Arasmith ..... 144/162.1 X

FOREIGN PATENT DOCUMENTS

GB 16931 of 1890

* cited by examiner

*Primary Examiner*—W. Donald Bray
(74) *Attorney, Agent, or Firm*—Alston & Bird LLP

(57) ABSTRACT

An improved method and apparatus which cuts certain wood pieces, commonly referenced as "mill ends," such that the chips can be used to make paper, cardboard and other recyclable materials. The use of a horizontal drum in combination with a horizontal anvil and a "moving cavity" which orients elongate elements, is likewise contemplated.

8 Claims, 5 Drawing Sheets

PLUNGER FULLY RETRACTED,
OVERS FALL DOWN

PLUNGER AND TOP PLATE
MOVING TOWARDS DRUM

TOP PLATE FULLY EXTENDED,
PLUNGER STILL EXTENDING

PLUNGER STROKE COMPLETE

TOP PLATE RETRACTED

AS CORNER "1" OF ANVIL WEARS OUT CORNERS 2,3, AND 4 CAN BE USED BY REMOUNTING ANVIL WITHIN FRAME OF APPARATUS

LUMBER TRIM END CHIPPER

CROSS-REFERENCE TO RELATED APPLICATION

The present application claims the full benefit and priority to pending provisional U.S. patent application No. 60/198,302, filed Apr. 19, 2000, and incorporates the entirety of said provisional application into the present nonprovisional application.

TECHNICAL FIELD

The present invention generally relates towards wood processing, and particularly relates to a method and apparatus for reducing mill ends (a.k.a. "trim ends") such as those provided by dimensional lumber processing.

BACKGROUND OF THE INVENTION

Lumber mills trim lumber to exact lengths, and trim out undesirable portions such as knots and other imperfections so as to improve the grade of lumber. The "trim ends" can be of various sizes, but typically includes various lengths of 2×4s, 2×6s, 2×8s, 2×12, 4×4s, 4×6s, etc. There is a need for a machine to reduce such trim ends to the proper size. Many different machines have been tried such as disc chippers, hogs, drum chippers, etc, with very little success. Therefore, improvements are needed.

SUMMARY OF THE INVENTION

The present invention overcomes deficiences in the prior art by providing an improved method and apparatus which cuts certain wood pieces, known as "mill ends", such that the chips can be used to make paper, cardboard, and other recyclable materials.

Therefore, it is an object of the present invention to provide an improved wood processing apparatus.

It is a further object of the present invention to provide an improved wood processing method.

It is a further object of the present invention to provide an improved method of processing wood members which is efficient in operation.

It is a further object of the present invention to provide an improved method of processing wood members which is simple in operation.

It is a further object of the present invention to provide an improved method of processing wood members which is effective in providing proper chip size.

It is a further object of the present invention to provide an improved apparatus for processing wood members which is efficient in operation.

It is a further object of the present invention to provide an improved apparatus for processing wood members which is simple in operation.

It is a further object of the present invention to provide an improved apparatus for processing wood members which is effective in providing proper chip size.

It is a further object of the present invention to provide an improved apparatus for processing wood members which is effective in recovering a maximum of proper size chips and thus reduces waste.

Other objects, features, and advantages of the present invention will become apparent upon reading the following detailed description of the preferred embodiment of the invention when taken in conjunction with the drawing and the appended claims.

BRIEF DESCRIPTION OF THE DRAWINGS

Figure 1:
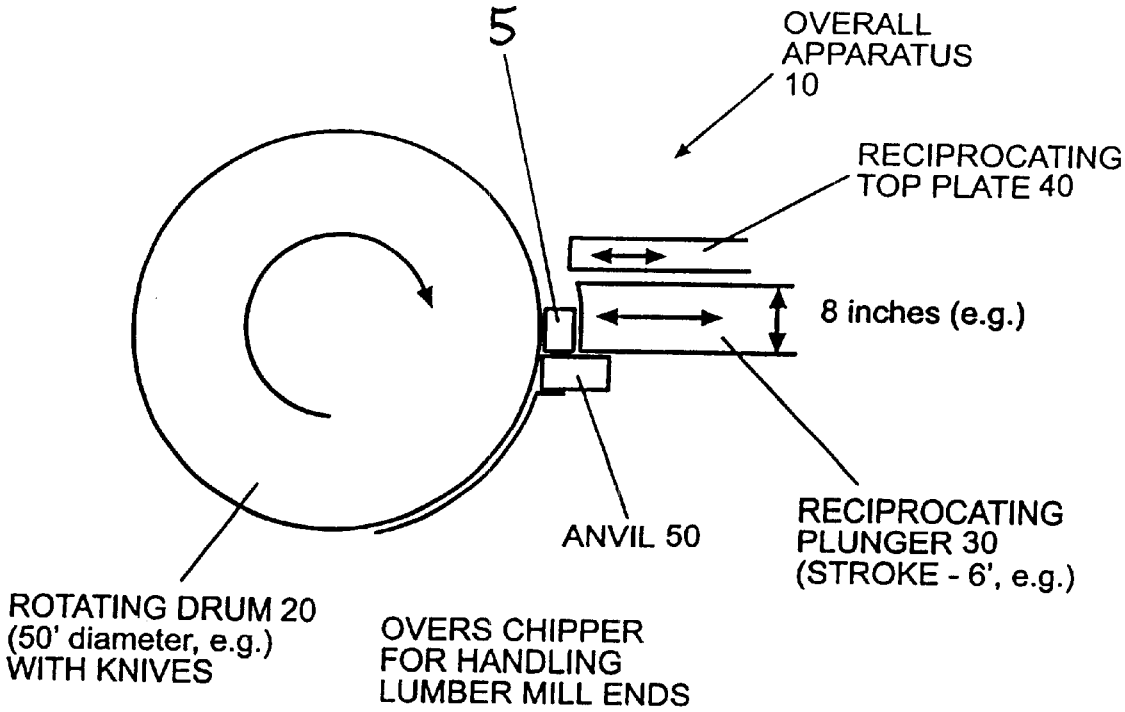

Having thus described the invention in general terms, reference will now be made to the accompanying drawings, which are not necessarily drawn to scale, and wherein:

FIG. 1 is a side elevational, illustrative, view of a rotating drum according to the present invention, configured to process lumber wood mill ends by use of a reciprocating top plate which is positioned above a reciprocating plunger. The plunger pushes the wood mill ends into contact with the rotating drum, which works in combination with the anvil to process the wood mill ends in a particular manner. Preferably the mill ends are oriented as noted below.

FIGS. 2A–2F are sequential views of a process according to the present invention.

Figure 2A:
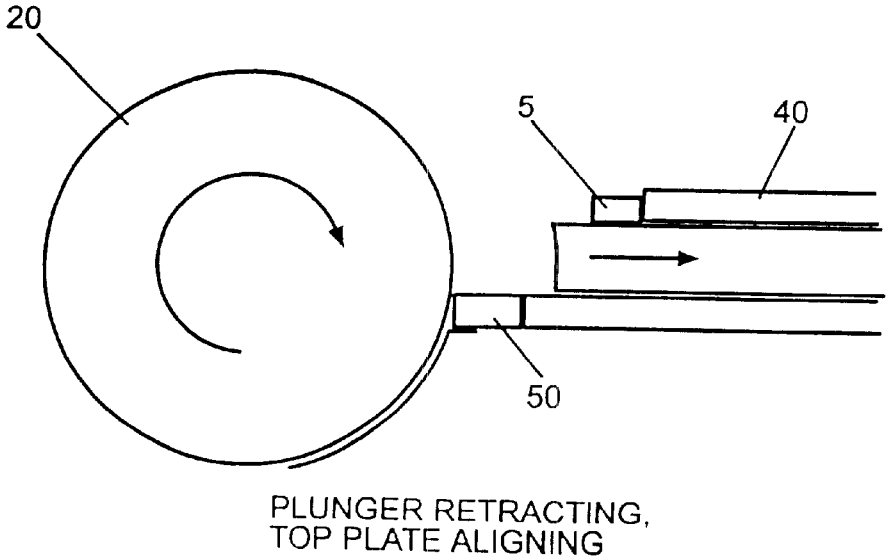

In FIG. 2A, the plunger is shown retracting with the top plate providing an aligning feature.

Figure 2B:
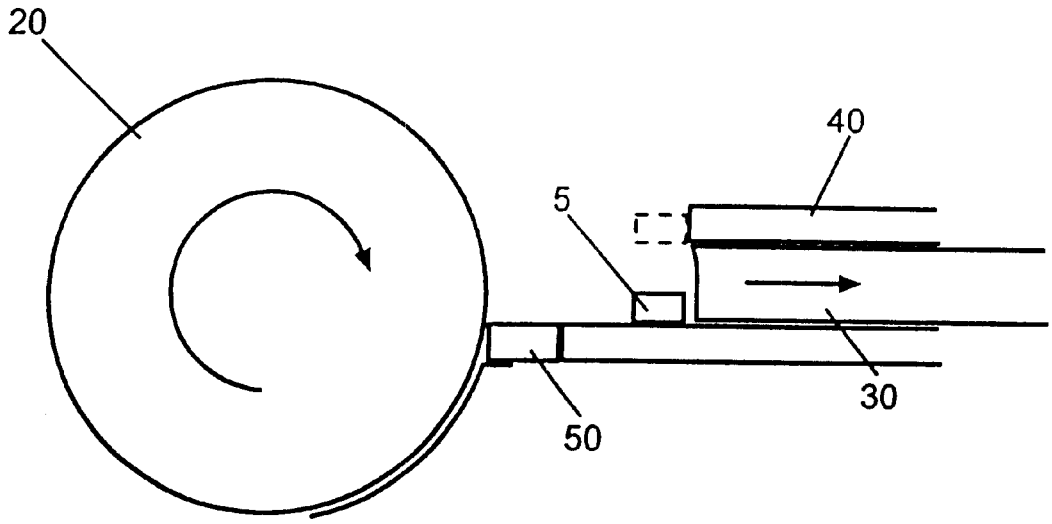

FIG. 2B illustrates the plunger being fully retracted, with the mill ends falling down from a top of the upper surface of the plunger. Preferably, some alignment has been provided by the top plate due to the previous step.

Figure 2C:
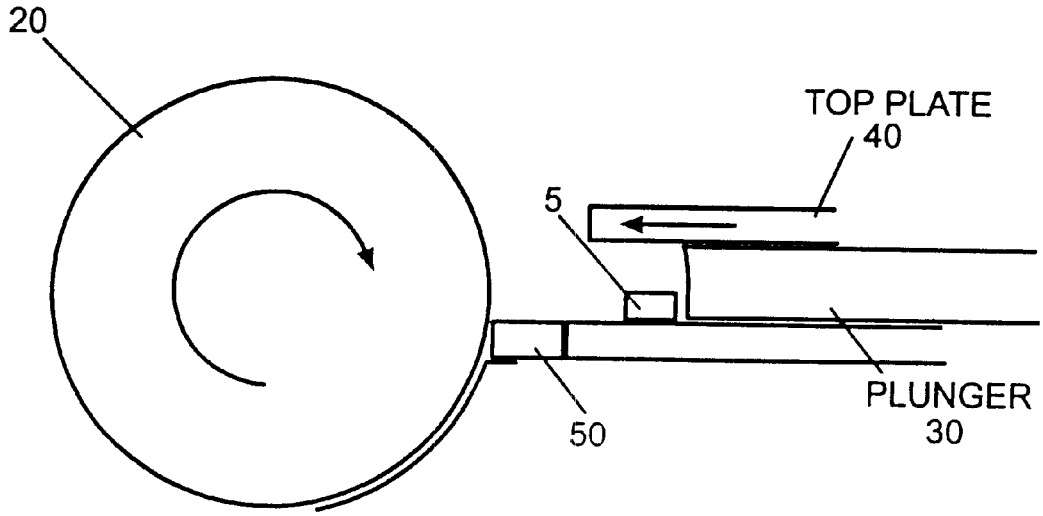

FIG. 2C illustrates the plunger and the top plate moving in tandem towards the drum. This could be known as a "moving cavity".

Figure 2D:
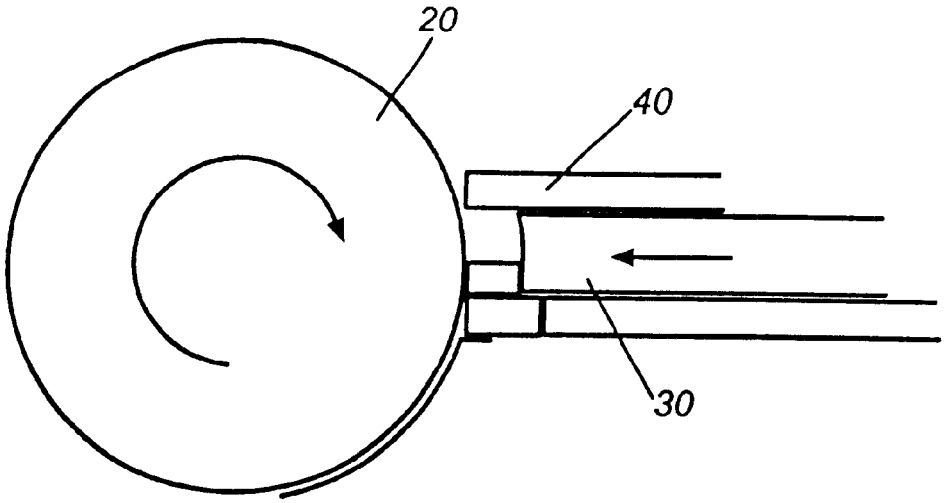

In FIG. 2D, the top plate is shown fully extended, and the plunger is still extending, with the wood being processed by the knives on the rotating drum.

Figure 2E:
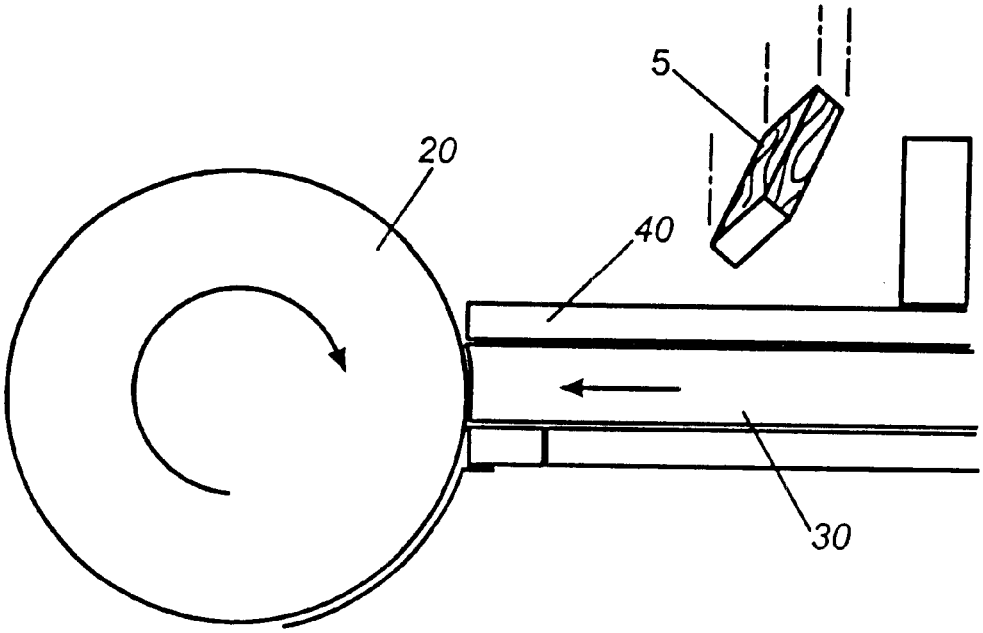

In FIG. 2E, the plunger stroke is complete, and the wood member has been essentially consumed from within the moving cavity.

Figure 2F:
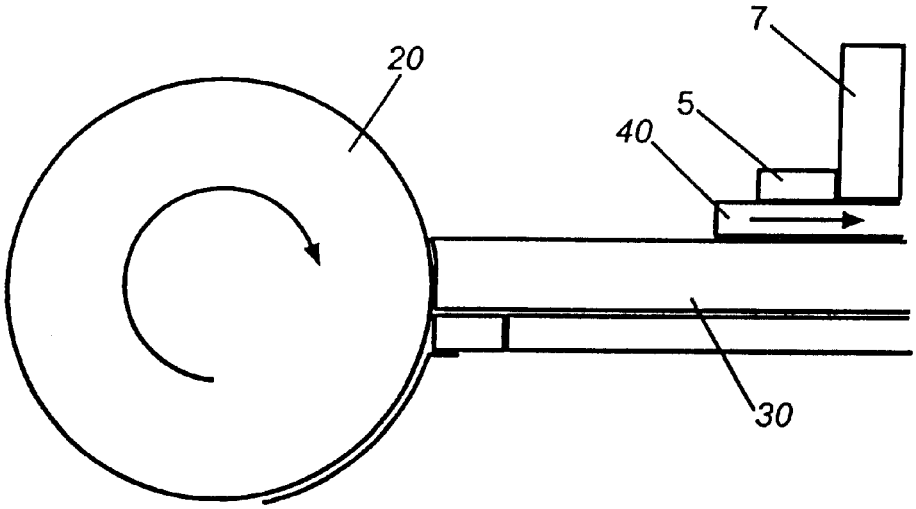

In FIG. 2F, the top plate is shown in its retracted configuration. At this point, the reciprocating plunger may be withdrawn. It may also be understood that wood mill ends which fall atop the upper surface of the plunger assembly may be aligned as shown in FIG. 2A. It should also be noted that alignment will occur during the retracting of the plunger (and/or the cover plate) as well as during the out stroke of either member.

Figure 3:
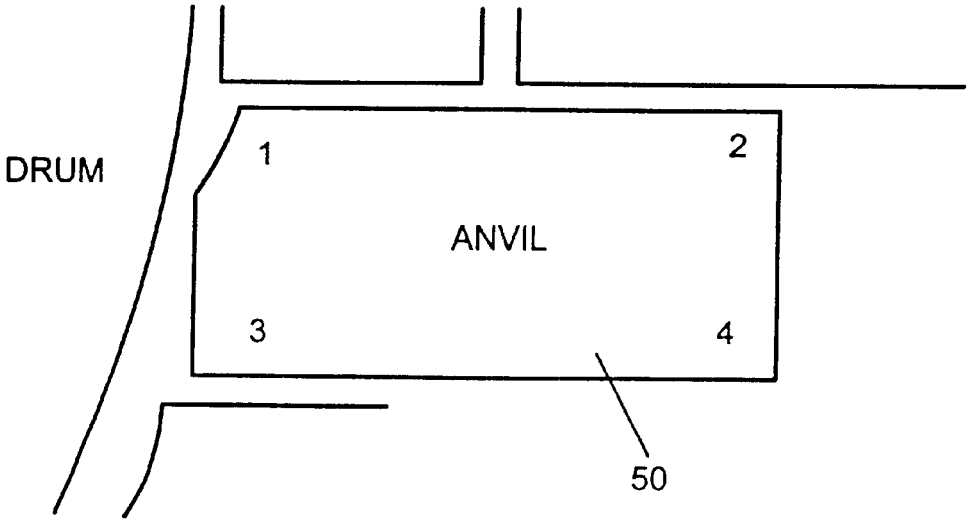

FIG. 3 is a close-up illustrative view of the anvil, shown in association with the drum and the other previously-discussed members. As may be understood, as the corner "1" becomes worn down by the cutting action, corners 2, 3, and 4 may be used by remounting the anvil within the frame of the apparatus.

Figure 4A:
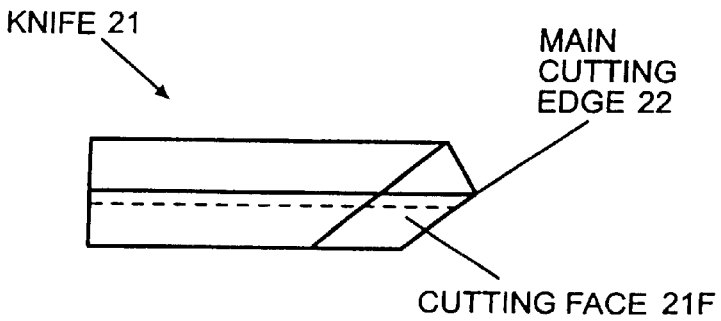
Figure 4B:
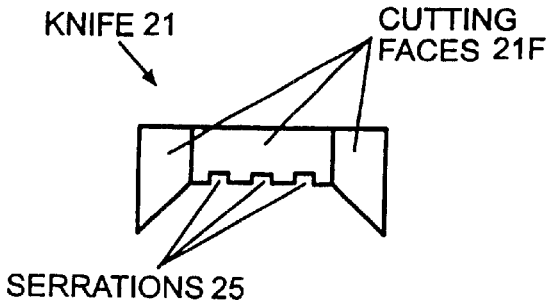
Figure 4C:
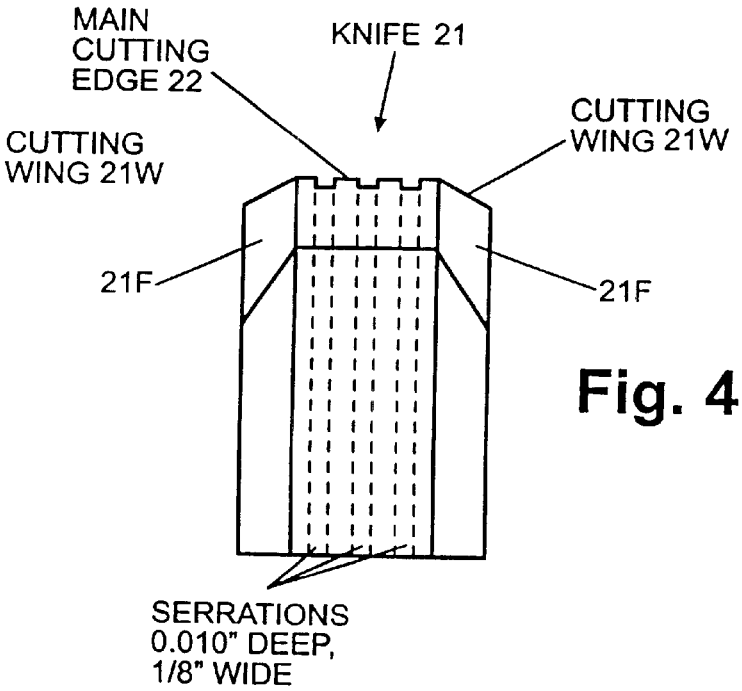

FIGS. 4A–4C are various views of one type of knife which may be used under the present invention. FIG. 4A shows the right side of the knife 21. FIG. 4B shows the front side of the knife 21 and FIG. 4C shows the top of the knife 21. The knife may or may not include the serrations.

DETAILED DESCRIPTION OF THE PREFERRED EMBODIMENT

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

Reference will now be made to the drawings, in which like numerals indicate like elements throughout the several views.

The purpose of the machine described is to cut the mill ends into smaller chips. The resulting smaller chips can then be used to make paper, cardboard and other recyclable material.

General Construction and Operation

Generally described, the apparatus 10 according to the present invention is configured to process lumber mill ends 5, and includes the following elements:

rotating cutting drum 20 reciprocating plunger 30 reciprocating top plate 40 anvil 50

Such mill ends 5 are dropped into the top of the apparatus and are consumed by the rotating drum 20 having knives thereon. One important feature of the invention is the preferred orientation of the mill ends relative the drum during the cutting process.

Reference will now be made FIGS. 1–4.

FIG. 1 is a side elevational, illustrative, view of a rotating drum according to the present invention, configured to process lumber wood mill ends by use of a reciprocating top plate which is positioned above a reciprocating plunger. The plunger reciprocates along a generally horizontal linear path, and pushes the wood mill ends (a.k.a. "wood trim") into contact with the rotating drum, which works in combination with the anvil to process the wood mill ends in a particular manner.

FIGS. 2A–2F are sequential views of a process according to the present invention.

In FIG. 2A, the reciprocating plunger 30 is shown retracting with the top plate providing an aligning feature. This aligning feature is provided by the interaction of the wood members with the top plate; as the plunger 30 retracts, eventually wood positioned atop the reciprocating plunger 30 will contact the reciprocating top plate 40. As the reciprocating plunger 30 continues to retract, the wood 5 thereon will tend to slide on the top of the plunger, as the wood is pushed against the leading, vertical, face of the reciprocating top plate 40.

FIG. 2B illustrates the reciprocating plunger 30 being fully retracted, with the mill ends falling down from a top of the upper surface of the plunger 30. Preferably, some alignment has been provided by the reciprocating top plate 40 due to the 5 previous step, so the moving cavity can maintain the wood member 5 in a desired orientation.

FIG. 2C illustrates the reciprocating plunger 30 and the reciprocating top plate 40 moving in tandem towards the rotating cutting drum 20. This could be known as a "moving cavity".

In FIG. 2D, the top plate is shown fully extended, and the reciprocating plunger 30 is still extending, with the wood being processed by the knives on the rotating cutting drum 20.

In FIG. 2E, the reciprocating plunger 30 stroke is complete, and the wood member 5 has been essentially consumed from within the moving cavity.

In FIG. 2F, the reciprocating top plate 40 is shown in its retracted configuration. At this point the reciprocating plunger 30 may be withdrawn. It may also be understood that wood mill ends 5 which fall atop the upper surface of the top plate 40 may be aligned against stationary member 7 (which could be a hopper wall) similar to that shown in FIG. 2A. It should also be noted that alignment will occur during the retracting of the plunger (and/or the cover plate) as well as during the out stroke of the various members.

FIG. 3 is a close-up illustrative view of the anvil 50, shown in association with the rotating cutting drum 20 and the other previously-discussed members. In one preferred embodiment the anvil will define a straight edge spaced approximately one-half inch from the drum surface, with the cutting elements extending just less (within acceptable tolerances) than that distance from the surface of the drum.

As may be understood, as the corner "1" becomes worn down by the cutting action, corners 2, 3, and 4 may be used by remounting the anvil 50 within the frame of the apparatus.

The reciprocating plunger 30 can be set upon bearings such as known in the art, including Nylatron bearing surfaces.

FIGS. 4A–4C are various views of one type of knife which may be used under the present invention. FIG. 4A shows the right side of the knife 21. FIG. 4B shows the front side of the knife 21 and FIG. 4C shows the top of the knife 21.

The knife 21 defines three cutting edges; a main cutting edge 22 and two side cutting edges defined by two corresponding cutting wings 21W. The two cutting wings define faces 21F, and one other face is defined by the main body of the knife. All of the cutting edges are defined by approximately 30 degree angles. The main cutting edge 22 cuts along the grain such that it effectively slices the wood fibers apart. The side cutting edges extend from the main cutting edges at approximately 45 degree angles, for effective cutting at 45 degrees across the wood grain. If desired, optional serrations may be provided such as 25 to provide additional breakup of the wood fibers.

Multiple knives 21 are positioned on the drum in spiral or other known overlapping configurations, such that during the initial cut, the three cutting edges enter a horizontal wood surface substantially simultaneously.

The Cutting Action and Orientation

Preferably, the orientation is such that the grain of the mill ends (at least the generally elongate ones) will be substantially aligned with the horizontal rotational axis of the cutting drum.

The rotating cutting drum 20 includes a plurality of spiral mounted knives thereon, which provide a cutting action which extends across the length of the drum.

Under one embodiment of the present invention, a 50-inch diameter drum at 300 RPM provides 3,926 FPM of knife speed. At 250 RPM the knife speed would be 3,272 FPM. This slower knife speed is very important to obtain a smoother cut and not shatter or fracture the chips.

At this much slower knife speed, combined with the configuration of the 30° defined cutting edges and the cutting wings on the knives slicing the fibers at 45° and the sharp cutting surface of the top of the knife cutting along the length of the fiber, the controlled feed rate of the moving cavity will then produce a very precise wood chip with very little waste in fines or overs.

Various alternatives are contemplated, including the use of two "lungers", one atop the other, with the lower plunger being less thick than other, but both including the leading curved surface. The lower plunger could be 6–8 inches thick and contemplated for use in processing smaller wood objects. The upper plunger could be larger (e.g., 18–24 inches thick, and could be used to process larger wood objects such as log cut-offs. Control of the two plungers could be independent, in that the lower plunger could be fully extended to act as a floor for the larger upper plunger to work off of.

Alternatively, the larger plunger could be allowed to frictionally slide relative to the lower plunger, with fictional engagement providing the following operational sequence. As the two plungers extend, eventually the upper (thicker) plunger will reach its limit and will be stopped thereby by a stop. The lower (thinner) plunger will continue to move out to its limit. The lower plunger will then be retracted, with the upper plunger being retracted therewith by fictional engagement. However, the top plunger will be stopped by a stop when its front face is substantially aligned with the rear, vertical, wall of the hopper 7. The lower plunger will continue to retract further to a more retracted position. When its movement is reversed so that it begins its plunging action, the upper one will be drawn along therewith by friction. The amount of overhang provides the desired "moving cavity". Such action may also be provided by two plungers of similar thickness. Another option includes the possibility of selectively locking the upper plunger in its retracted position.

Conclusion

Therefore it may be understood that the present invention overcomes deficiencies in the prior art by providing an improved method and apparatus which cuts certain wood pieces, known as "mill ends", such that the chips can be used to make paper, cardboard, and other recyclable materials.

While this invention has been described in specific detail with reference, to the disclosed embodiments, it will be understood that many variations and modifications may be effected within the spirit and scope of the invention as described in the appended claims.

What is claimed is:

1. An apparatus for processing wood members trimmed off of the ends of dimensional lumber and defined by six rectangular faces grouped into three pairs of opposing, substantially parallel, faces, said apparatus comprising:

a frame;

a first plunger movable relatively to said frame from a first location to a second location, said first plunger configured for pushing said wood members;

a second plunger movable relatively to said frame from a first location to a second location, said second plunger configured for pushing said wood members;

a rotating drum having a horizontal rotation axis;

a plurality of cutting members extending from said rotating drum; and an anvil defining a substantially horizontal surface relative to said rotating drum, said anvil having a working edge spaced apart from said drum to define an elongate gap therebetween, such that rotating said drum while moving said second plunger from said first location to said second location causes wood members to be pushed into said cutting members and moved by said cutting members until stopped by said anvil, and thereafter cut into wood chips which pass through said gap intermediate said drum and said anvil.

2. The apparatus as claimed in claim 1, wherein said rotating drum rotates at approximately 300 RPM providing approximately 3,926 FPM of knife speed.

3. The apparatus as claimed in claim 1, wherein said rotating drum rotates at approximately 250 RPM providing approximately 3,272 FPM of knife speed.

4. The apparatus as claimed in claim 1, further comprising an aligning member defining an aligning surface, which tends to align said elongate wood members upon retraction of said top plate.

5. A method for processing wood members trimmed off the ends of elongate dimensional lumber and defined by six rectangular faces grouped into three pairs of opposing, substantially parallel, faces, said method comprising the steps of:

providing a frame;

providing a first plunger movable relatively to said frame from a first location to a second location said first plunger configured for pushing said wood members;

providing a second plunger movable relatively to said frame from a first location to a second location said second plunger configured for pushing said wood members;

providing a rotating drum having a horizontal rotation axis;

providing a plurality of cutting members extending from said rotating drum; and providing an anvil defining a substantially horizontal surface relative to said rotating drum, said anvil having a working edge spaced apart from said drum to define an elongate gap therebetween, rotating said drum while moving said second plunger from said first location to said second location such that wood members are pushed into said cutting members and moved by said cutting members until stopped by said anvil, and thereafter cut into wood chips which pass through said gap intermediate said drum and said anvil.

6. The method as claimed in claim 5, wherein said rotating drum rotates at approximately 300 RPM providing approximately 3,926 FPM of knife speed.

7. The method as claimed in claim 5, wherein said rotating drum rotates at approximately 250 RPM providing approximately 3,272 FPM of knife speed.

8. The method as claimed in claim 5, further comprising an aligning member defining an aligning surface, which tends to align said elongate wood members upon retraction of said top plate.

* * * * *